US009822644B2

(12) United States Patent
Tardif et al.

(10) Patent No.: US 9,822,644 B2
(45) Date of Patent: Nov. 21, 2017

(54) ROTOR BLADE VIBRATION DAMPER

(71) Applicant: PRATT & WHITNEY CANADA CORP., Longueuil (CA)

(72) Inventors: Marc Tardif, Candiac (CA); Domenico Di Florio, St. Lazare (CA); Aldo Abate, Longueuil (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 246 days.

(21) Appl. No.: 14/633,503

(22) Filed: Feb. 27, 2015

(65) Prior Publication Data

US 2016/0251963 A1 Sep. 1, 2016

(51) Int. Cl.

| | |
|---|---|
| ***F01D 5/10*** | (2006.01) |
| ***F01D 5/30*** | (2006.01) |
| ***F01D 5/22*** | (2006.01) |

(52) U.S. Cl.

CPC ..... *F01D 5/10* (2013.01); *F01D 5/22* (2013.01); *F01D 5/3007* (2013.01); *F05D 2220/32* (2013.01); *F05D 2260/96* (2013.01)

(58) Field of Classification Search

CPC . F01D 5/10; F01D 5/16; F01D 5/3007; F01D 5/326; F01D 5/323; F01D 5/3015; F01D 5/22; F01D 11/008; Y10S 416/50; F05D 2220/32; F05D 2260/96

USPC ..... 415/190; 416/215, 106, 193 A, 196 R, 416/208, 217, 500, 194

See application file for complete search history.

(56) References Cited

U.S. PATENT DOCUMENTS

| | | | | |
|---|---|---|---|---|
| 4,101,245 | A * | 7/1978 | Hess | F01D 5/22 416/190 |
| 4,457,668 | A * | 7/1984 | Hallinger | F01D 5/26 416/190 |
| 5,281,097 | A | 1/1994 | Wilson et al. | |
| 5,460,489 | A | 10/1995 | Benjamin et al. | |
| 5,785,499 | A | 7/1998 | Houston et al. | |
| 5,803,710 | A | 9/1998 | Dietrich et al. | |
| 5,827,047 | A | 10/1998 | Gonsor et al. | |
| 5,924,699 | A | 7/1999 | Airey et al. | |
| 6,171,058 | B1 * | 1/2001 | Stec | F01D 5/22 416/193 A |
| 7,121,800 | B2 | 10/2006 | Beattie | |
| 7,214,034 | B2 | 5/2007 | Giot et al. | |

(Continued)

FOREIGN PATENT DOCUMENTS

WO 2014001084 1/2014

*Primary Examiner* — Nathaniel Wiehe
*Assistant Examiner* — Joe Gonzalez, Jr.
(74) *Attorney, Agent, or Firm* — Norton Rose Fulbright Canada LLP

(57) ABSTRACT

A rotor blade vibration damper for a gas turbine engine includes an elongated damper body including a top portion extending longitudinally between a front end and a rear end. The top portion has a width defined between spaced apart lateral sides and is substantially flat between the front and rear ends and between the lateral sides such as to define a longitudinal plane within which the top portion lies. A front tab extends downwardly from the front end of the top portion relative to the longitudinal plane. The rear end of the top portion is flat and generally contained in the longitudinal plane. A pair of lateral tabs extends downwardly from each of said lateral sides of the top portion relative to the longitudinal plane.

20 Claims, 8 Drawing Sheets

(56) References Cited

U.S. PATENT DOCUMENTS

| | | | | |
|---|---|---|---|---|
| 7,322,797 | B2 | 1/2008 | Lee et al. | |
| 8,393,869 | B2 | 3/2013 | Kim et al. | |
| 8,888,456 | B2 | 11/2014 | Borufka et al. | |
| 2015/0226077 | A1* | 8/2015 | Beattie | F01D 5/26 416/174 |

* cited by examiner

ROTOR BLADE VIBRATION DAMPER

TECHNICAL FIELD

The application relates generally to gas turbine engines and, more particularly, to dampers in rotor blades.

BACKGROUND

Gas turbine engines have various rotating parts which may be subjected to vibratory stresses. Turbines, for example, have a plurality of blades extending radially from a rotating hub or disk. When the turbine disk is rotating, the radial length of the blades contributes to the formation of vibration which may increase stresses in the blades. Dampers may be used to reduce some of the vibrations transmitted to the blades by dissipating energy through friction between the damper and the blade it is mounted on.

SUMMARY

In one aspect, there is provided a rotor blade vibration damper comprising: an elongated damper body including a top portion extending longitudinally between a front end and a rear end, the top portion having a width defined between spaced apart lateral sides and being substantially flat between the front and rear ends and between the lateral sides such as to define a longitudinal plane within which the top portion lies, a front tab extending downwardly from the front end of the top portion relative to the longitudinal plane, the rear end of the top portion being flat and generally contained in the longitudinal plane, and a pair of lateral tabs extending downwardly from each of said lateral sides of the top portion relative to the longitudinal plane.

In another aspect, there is provided a gas turbine engine comprising: a rotor including a hub defining a central axis of rotation and a plurality of blades radially extending from the hub, each of the blades having: an airfoil portion; and a root portion, wherein each pair of adjacent blades have facing pressure side and suction side recesses in the root portion, the facing pressure side and suction side recesses forming a cavity therebetween; and a vibration damper disposed within each of the cavities, the vibration damper being displaceable radially within the cavity, the vibration damper including: an elongated damper body having a length extending axially between upstream and downstream ends and a width extending circumferentially between spaced apart lateral sides, the damper body including a top portion conforming to a top wall of the cavity, a front tab extending generally radially inwardly from the upstream end, a lateral tab extending generally radially inwardly from each of the lateral sides of the elongated portion, the downstream end being flat and generally aligned with the top portion.

DESCRIPTION OF THE DRAWINGS

Reference is now made to the accompanying figures in which.

DETAILED DESCRIPTION

Figure 1:
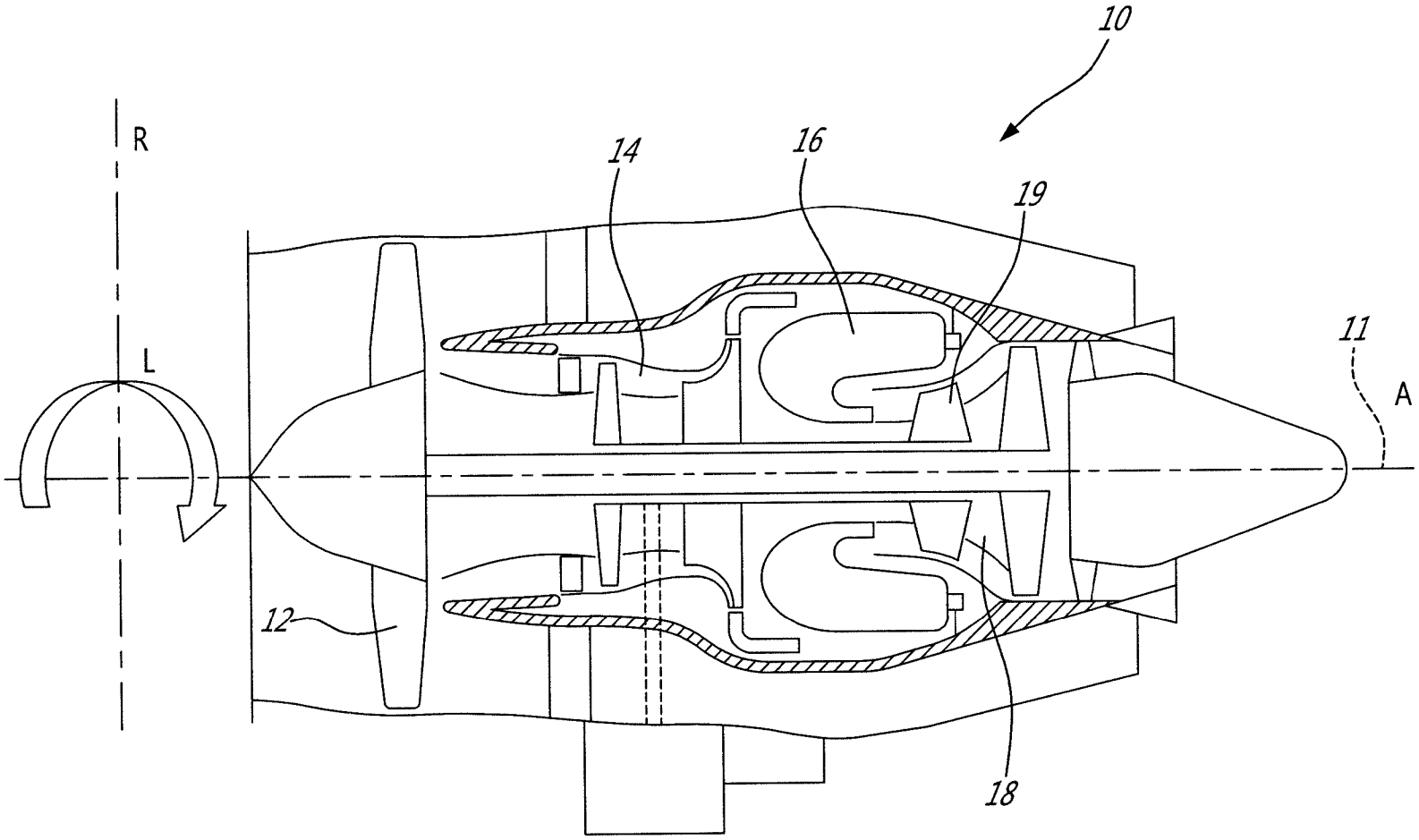
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 (including a compressor-high pressure-turbine 19) for extracting energy from the combustion gases. The gas turbine engine 10 includes having an engine axis 11 defining an axial direction A. Although depicted as a turbofan gas turbine engine in the disclosed non-limiting embodiment, it should be understood that the concepts described herein are not limited to use with turbofans as the teachings may be applied to other types of turbine engines such as turboprop.

Figure 2A:
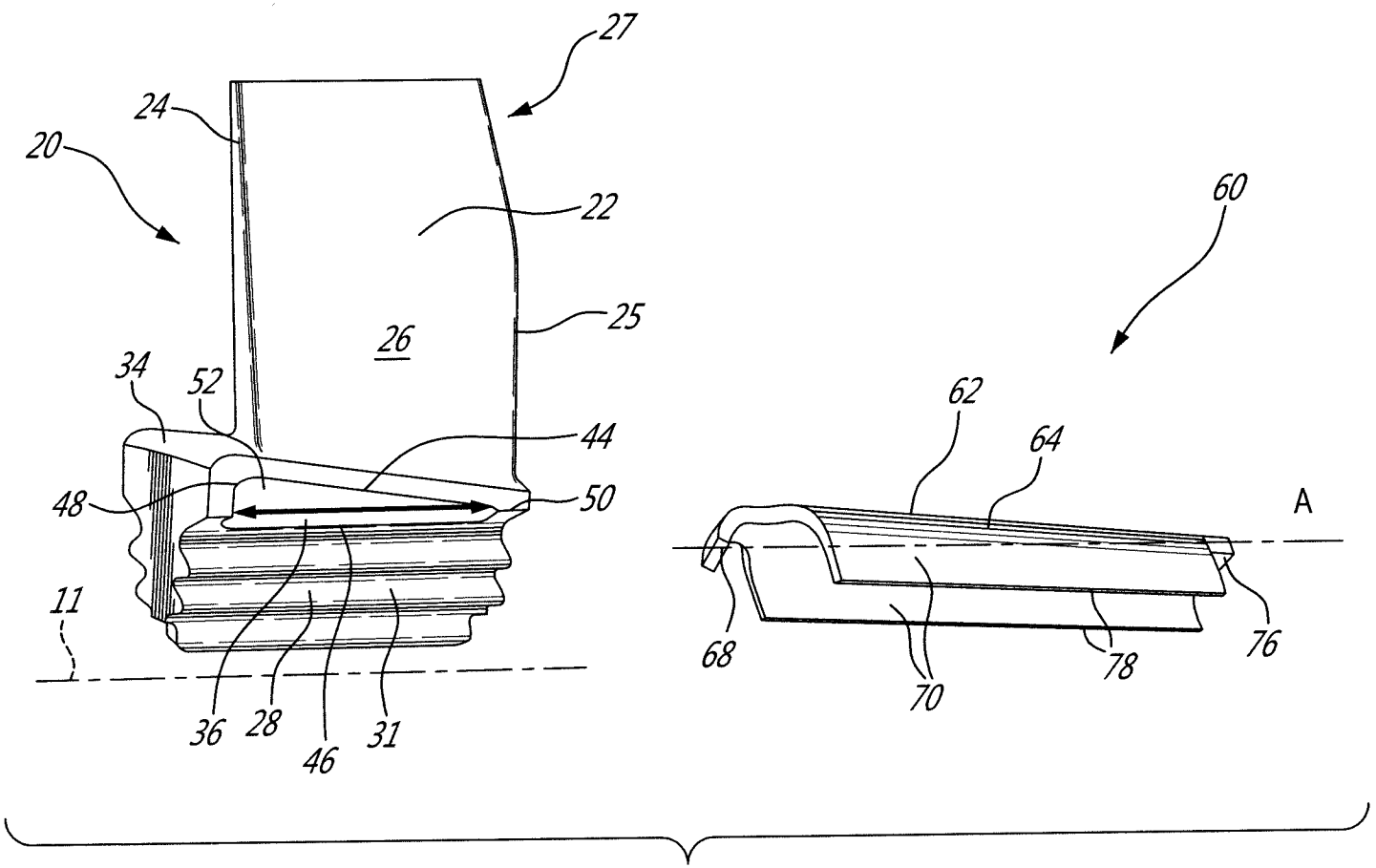
FIG. 2A is a schematic perspective exploded view of a portion of a rotating blade and its associated damper for the gas turbine engine of FIG. 1.
Figure 2B:
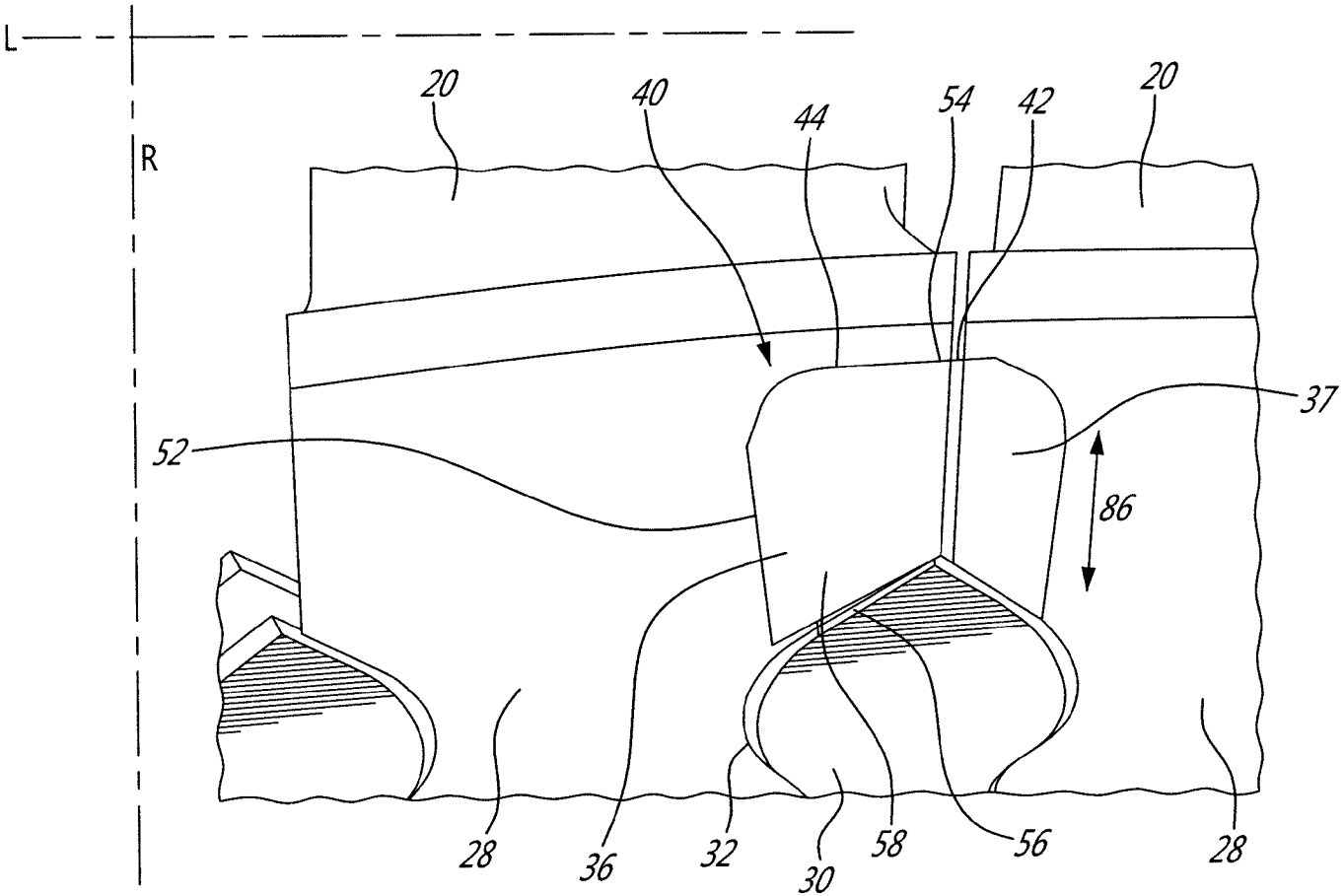
FIG. 2B is a schematic front view of portions of two adjacent rotor blades showing in transparency a cavity receiving the damper of FIG. 2A.

Referring now to FIGS. 2A and 2B, the compressor turbine 19 of the turbine section 18 includes a plurality of radially extending blades 20. The compressor turbine 19 rotates about a central axis that is the engine axis 11. The blades 20 each include an airfoil portion 22 having a leading edge 24, a trailing edge 25, a pressure side 26 and a suction side 27.

For ease of description of some of the elements described in this specification, localised orientations related to the leading edge 24 will be referred as "front", orientations related to the trailing edge 25 will be referred as "rear", orientations related to the pressure side 26 and a suction side 27 will be referred as "lateral", and orientations related to a radial positioning will be referred as "top" and "bottom" or using formulations such as "up" and "down".

Figure 4:
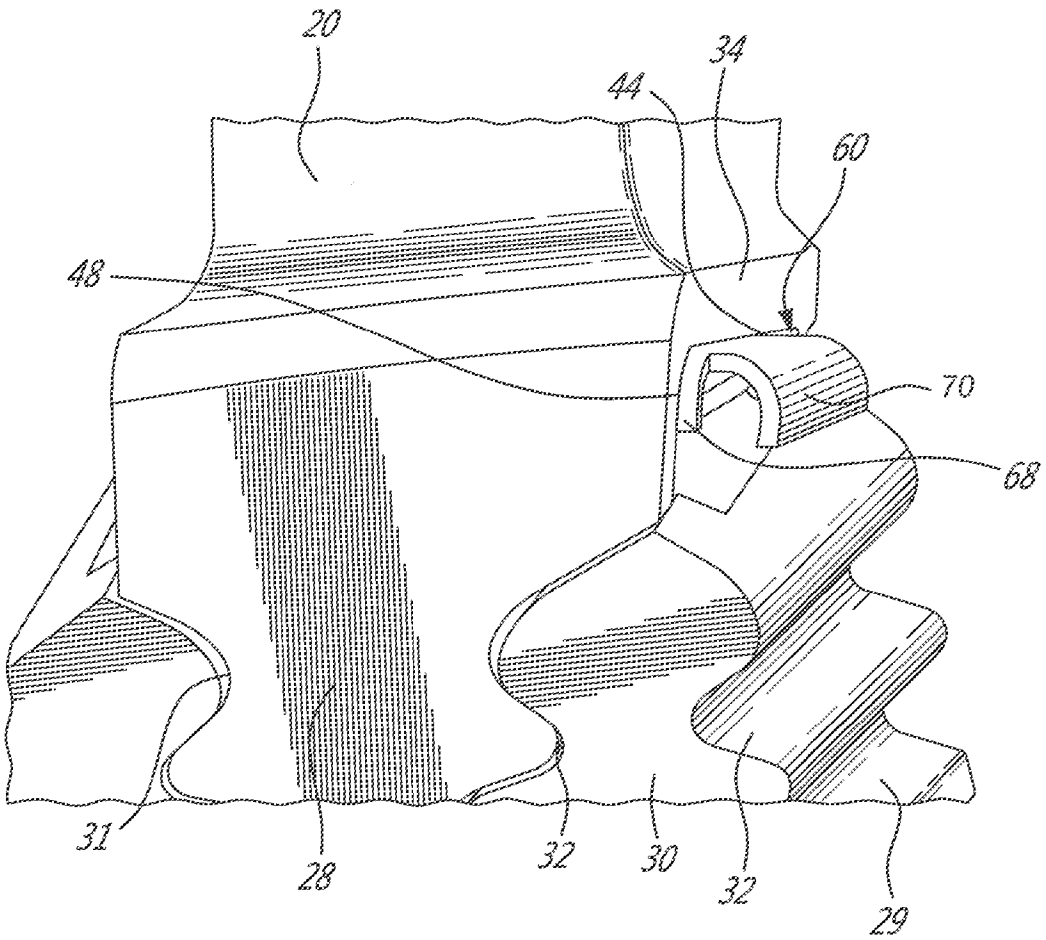
FIG. 4 is a schematic perspective view of a portion of the rotating blade and the damper of FIG. 2A inserted in a hub of the gas turbine engine of FIG. 1.

Each blade 20 includes a root portion 28 insertable in fir-tree slots 29 formed in a hub 30 of the compressor turbine 19 (shown in FIG. 4). The root portion 28 includes a plurality of lobes 31 which cooperate with mating recesses 32 of the fir-tree slots 29.

As seen in FIG. 2A, a laterally extending platform 34 is disposed radially between the root portion 28 and the airfoil portion 22. The platform 34 is inclined downwardly from the leading edge 24 to the trailing edge 25 in the axial direction A. A pressure side recess 36 (shown in FIG. 2A) and a suction side recess 37 (shown only partially in FIG. 2B) are formed immediately below (i.e. radially inwardly) the platform 34 on the pressure side 26 and suction side 27 respectively. Each blade 20 has a pressure side recess 36 and a suction side recess 37 such that in every two adjacent blades, a pressure side recess 36 is facing a suction side recess 37, forming together a cavity 40 (shown in FIG. 2B). The cavity 40 may not be closed. A gap 42 may be formed between the adjacent blades 20.

The recesses 36, 37 have, in the illustrated embodiment, different sizes and to a certain extent shapes from one another. As best illustrated in FIG. 2B, the pressure side recess 36 is deeper laterally than the suction side recess 37, though they could be of the same size and shape. Because the recesses 36, 37 have an overall similar shape, for ease of understanding, detailed description of the recesses 36, 37 will be made below for the pressure side recess 36 only with reference to FIG. 2A.

The recess 36 has a general triangular axial cross-sectional shape. Radially, an underside 44 of the platform 34 defines an upper end of the pressure side recess 36. A bottom end 46 of the pressure side recess 36 is open. When the blade 20 is inserted in the fir-tree slots 29 of the hub 30, the hub 30 closes the open bottom end 46. Axially, a front end of the pressure side recess 36 is defined by a leading edge wall 48 and a rear end of the pressure side recess 36 is defined by a junction 50. The leading edge wall 48 extend radially inwardly from the platform 34. The junction 50 is formed by trailing ends of the underside 44 and the open bottom end 46. Laterally, the pressure side recess 36 extends between a recess wall 52 and an open end. It is contemplated that the pressure side recess 36 could have various shapes. For example, the pressure side recess 36 could be rectangular shaped as opposed to triangular.

Referring more particularly to FIG. 2B, the cavity 40 formed by the facing recesses 36, 37 includes a top end 54 formed by the association of the undersides 44 of the platform 34 of the adjacent blades 20, a bottom end 56 formed by the hub 30, a front end 58 formed by the leading edge walls 48 of the adjacent blades 20, a rear end (not shown) formed by the junctions 50 of the adjacent blades 20, and lateral sides by the recess walls 52 of the recesses 36, 37.

A damper 60 (shown in FIG. 2A) is received in the cavity 40 such that the pressure side recess 36 and suction side recess 37 each receive a portion of the damper 60. The damper 60 is sized and dimensioned to at least reduce vibratory stresses on the blades. These vibratory stresses can occur when the gas turbine engine 10 is running and the blades 20 vibrate when rotating. The damper 60 may have additional sealing properties.

The cavity 40 is slightly bigger than the damper 60 such that the damper 60 may move to a certain extent within the cavity 40. The damper 60 is the sole element received in the cavity 40 and is, in the illustrative embodiment, free standing or "floating". This means that the damper 60 is not hooked to or abutting protrusions defined in the recesses 36, 37 so as to keep the damper 60 in place. Instead the damper 60 may move from a position where it abuts the hub 30 when the engine 10 is at rest and the blades 20 are not rotating, to a position where it abuts the underside 44 of the platform 34 when the engine 10 is running and the blades 20 are rotating. The radial displacement of the damper 60 is due to the centrifugal forces generated by the rotation of the blades 20. In some cases, the damper 60 may move axially, for example, under vibratory forces, should the length of the damper 60 be smaller than the length of the cavity 40.

The damper 60 includes a damper body 62 elongated in the axial direction A. When the damper 60 is disposed in the pressure side recess 36 (or suction side recess), the axial direction A may be parallel to the engine axis 11. The damper body 62 is made of a material resistant to the temperature typically experienced when the gas turbine engine 10 is running. The damper 60 may be integrally formed, or formed of folded sheet metal.

Figure 3A:
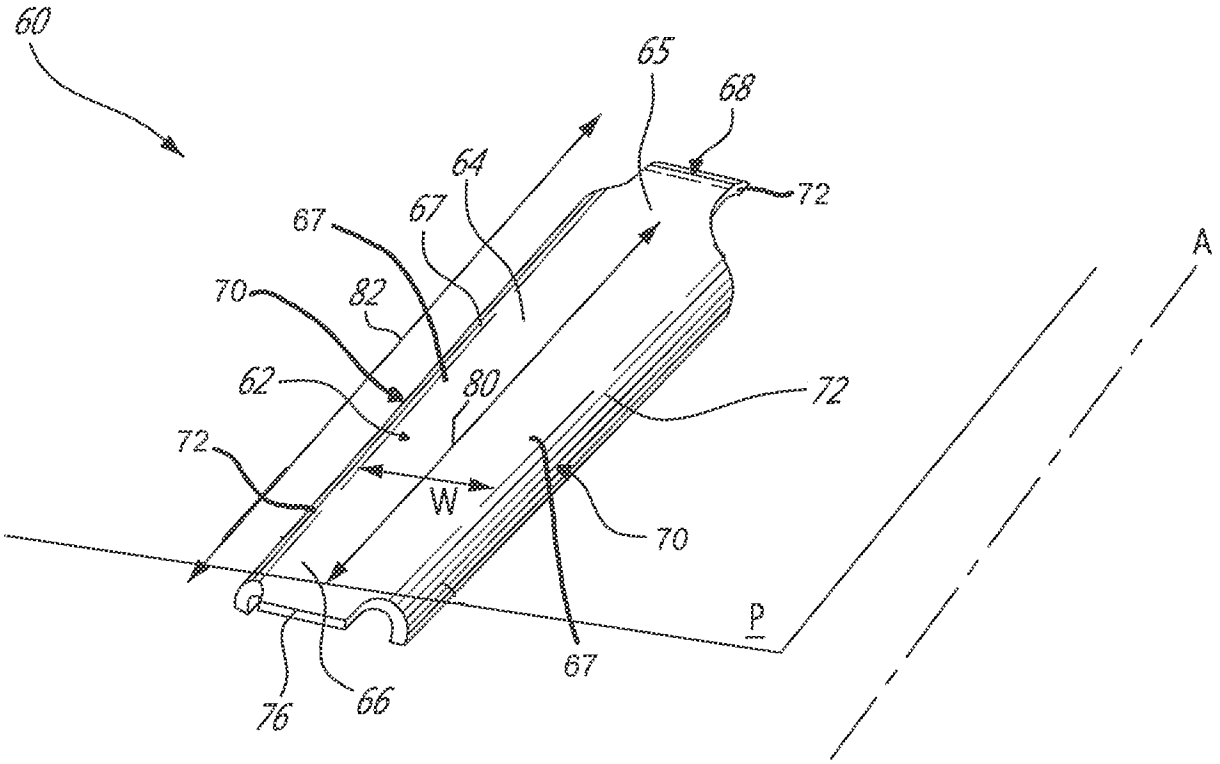
FIG. 3A is a schematic rear perspective view of the damper of FIG. 2A.
Figure 3B:
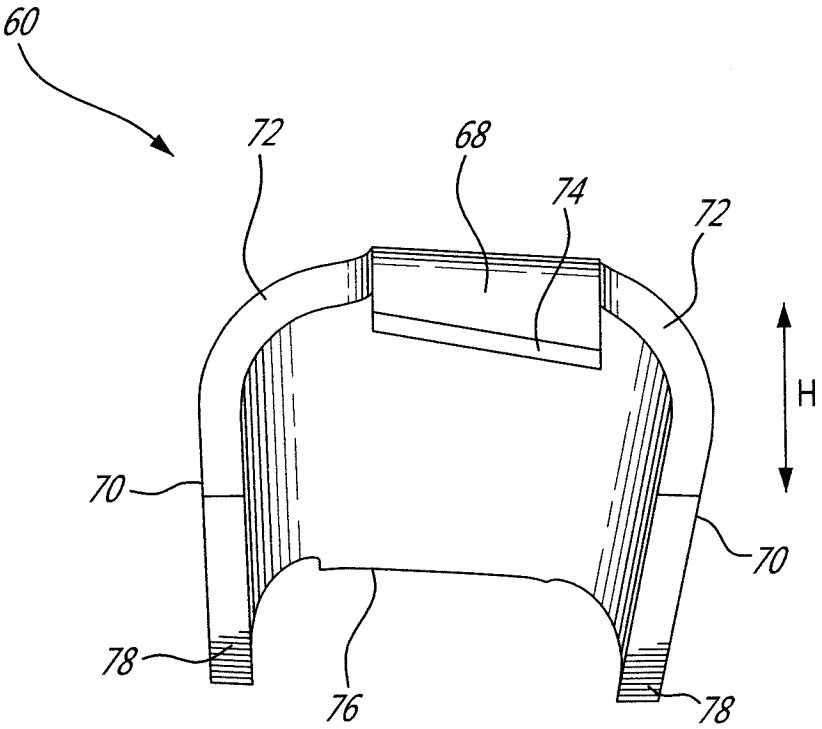
FIG. 3B is a schematic front perspective view of the damper of FIG. 2A.

Referring now to FIGS. 3A and 3B, the damper body 62 has a top portion 64 having a front end 65, a rear end 66, and lateral sides 67. The top portion 64 is generally rectangular, has a width W in a circumferential direction L (shown in FIG. 1), and is tapered toward the rear end 66. The top portion 64 is to be in contact with the undersides 44 of the platforms 34 of the adjacent blades 20 and may act as a seal and as a vibratory stress damper, for example, in at least a radial direction R (shown in FIG. 1). Damping may occur along the top portion 64 contacting the undersides 44 of the platforms 34 by relative micro-movement of the damper 60 with respect to the undersides 44 of the platforms 34. Vibratory energy absorbed by this frictional relative motion is turned into heat. The top portion 64 is flat and is contained in an axially extending longitudinal plane P.

A front tab 68 extends downwardly (i.e. radially inwardly) from the top portion 64. The front tab 68 is to be in contact with the leading edge walls 48 of the adjacent blades 20, and may prevent a flip of the damper 60 when the damper 60 is moving in the cavity 40. The front tab 68 may also provide additional damping, for example, in the axial direction A. Two lateral tabs 70 extend downwardly (i.e. radially inwardly) from the lateral sides 67 of the top portion 64, and are to be in contact each with the recess walls 52 of the recesses 36, 37. The lateral tabs 70 may prevent locking of the damper 60 and may also provide additional damping, for example, in the circumferential direction L. In the illustrated embodiment, the front tab 68 is spaced apart from the lateral tabs 70. It is however contemplated that the front tab 68 could connect with the lateral tabs 70. Connection to the lateral tabs 70 may however be more complex to manufacture the damper 60 and add unnecessary weight.

The front tab 68 and the lateral tabs 70 extend generally perpendicular from the top portion 64 form curved edges 72 with the top portion 64. A curvature of the edges 72 matches that of the recesses 36, 37 so that when the damper 60 is inserted in the recesses 36, 37, it stays in a predefined position when the blades 20 are rotating. In addition, the curved edges 72 may prevent digging of the damper 60 in the blade 20 when the gas turbine engine 10 is in operation. The edges 72 may be more or less curved, and the front tab 68 and the lateral tabs 70 may extend from the top portion 64 at an angle other than 90 degrees depending on a shape of the cavity 40. They could, for example, flare outwardly or inwardly.

In the illustrated embodiment, the front tab 68 has bottom end 74 (shown in FIG. 3B) that is included and thus that is not parallel to plane P of the top portion 64. This provides a tapered shape to the front tab 68. The bottom end 74 is inclined, in circumferential direction L, to match a shape of the hub 30. It is however contemplated that the bottom end 74 of the front tab 68 could be straight, and thus parallel to the top portion 64, or have another shape depending on the shape of the hub 30.

Because of the triangular axial cross-sectional shape of the recesses 36, 37, the damper body 62 does not have a trailing edge tab. Instead it has a projecting flat tab 76 (see FIG. 3A) which may contact the junction 50. It is however contemplated that depending on the shape of the recess (for example if it was square or trapezoidal), the damper body 62 could have a trailing edge tab with a size and shape similar or different from that of the front tab 68. The damper body 62 could also not have the flat tab 76 at all.

The lateral tabs 70 have a bottom end 78 which is inclined slightly toward the rearward end of the damper body 62 and the flat tab 76. In the illustrated embodiment, an inclination of the bottom end 78 of the lateral tabs 70 is much lesser than an inclination of the bottom ends 46 of the recesses 36, 37. It is however contemplated that the inclinations of the bottom ends 78 of the lateral tabs 70 and the bottom ends 46 of the recesses 36, 37 could match. In the illustrated embodiment, the lateral tabs 70 extend continuously substantially along an entire length 80 (shown in FIG. 3A) of the top portion 64. It is however contemplated that the lateral tabs 70 could be shorter axially than the top portion 64, or could have some discontinuity and be formed of a plurality of lateral tabs 70.

The damper 60 may tight fit the cavity 40 or may have a size smaller than that of the cavity 40, the latter being that of the illustrated embodiment. The damper 60 may be smaller than the cavity 40 radially and/or axially. A damper 60 that is not tight-fit in the cavity 40 may allow for an easier installation. Axially, a length 82 (shown in FIG. 3A) of the damper 60 may be at least 50% of an axial length of the cavity 40. In one embodiment, the length 82 of the damper 60 is at least 60% of the axial length of the cavity 40. In one embodiment, the length 82 of the damper 60 is at least 70% of the axial length of the cavity 40. In one embodiment, the length 82 of the damper 60 is at least 80% of the axial length of the cavity 40. In one embodiment, the length 82 of the damper 60 is at least 90% of the axial length of the cavity 40.

Radially, a height H of the damper 60 may be at least 50% of a height 86 (shown in FIG. 2B) of the cavity 40. In one embodiment, the height H of the damper 60 is at least 60% of the height 86 of the cavity 40. In one embodiment, the height H of the damper 60 is at least 70% of the height 86 of the cavity 40. In one embodiment, the height H of the damper 60 is at least 80% of the height 86 of the cavity 40. In one embodiment, the height H of the damper 60 is at least 90% of the height 86 of the cavity 40.

The shape and size of the damper 60 may be chosen to match (or conform) that of the top end 54 and the front end 58 of the cavity 40 in order to maximise a contact area between the damper 60 and the cavity 40. Therefore, the top portion 64 and/or tabs 68, 70 may be shaped and sized to match the shape and size of the top end 54 and the front end 58 of the cavity 40. It has been found that a greater contact area between the damper 60 and the cavity 40 resulted in a decrease of vibratory stresses. The damper 60 may be designed to reduce all or some of the vibratory stresses, such as modal crossing interferences in the running range. In one embodiment, the damper may be designed to reduce stresses of the blade fundamental vibratory mode.

The weight of the damper 60 may be adjusted by adjusting a radial thickness of the damper body 62 and/or a length of the tabs 68, 70, 76. In particular, when retrofitting, the weight of the damper 60 may be calculated so that when the blades 20 are rotating, the damper 60 does not add too much weight to the blades 20 it is disposed in, to limit or avoid any additional stresses being induced in the blades 20 by centrifugal forces.

Figure 5:
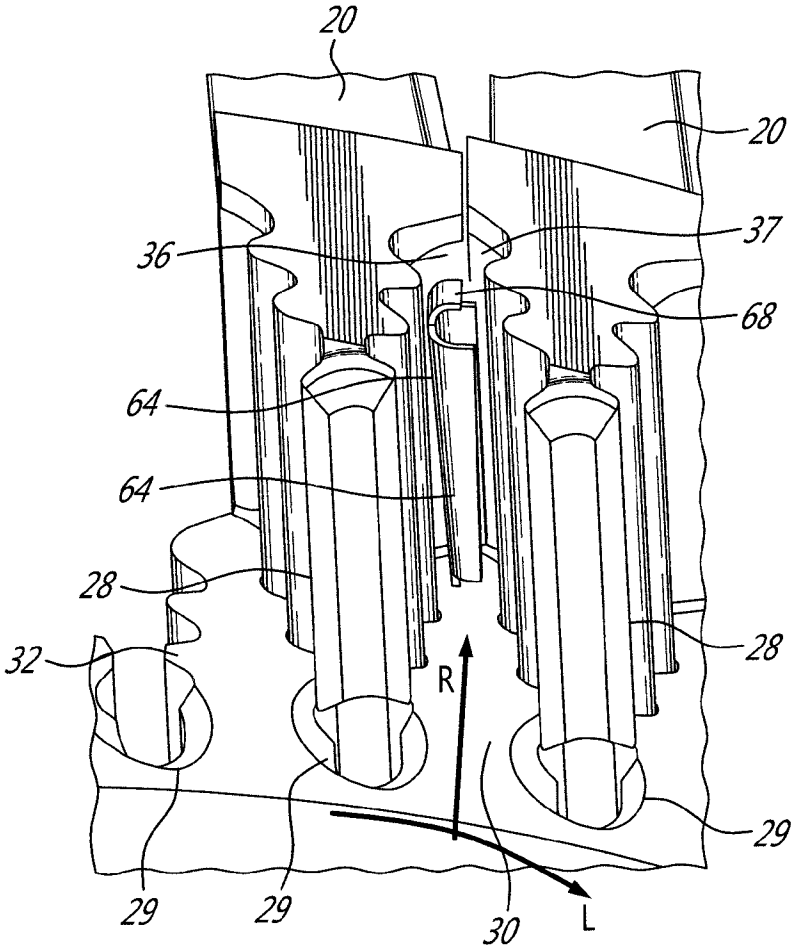
FIG. 5 is a schematic perspective exploded view of portions of adjacent rotor blades and the damper of FIG. 2A during a first step of installation of the damper and the blades in a hub of the gas turbine engine of FIG. 1.
Figure 6:
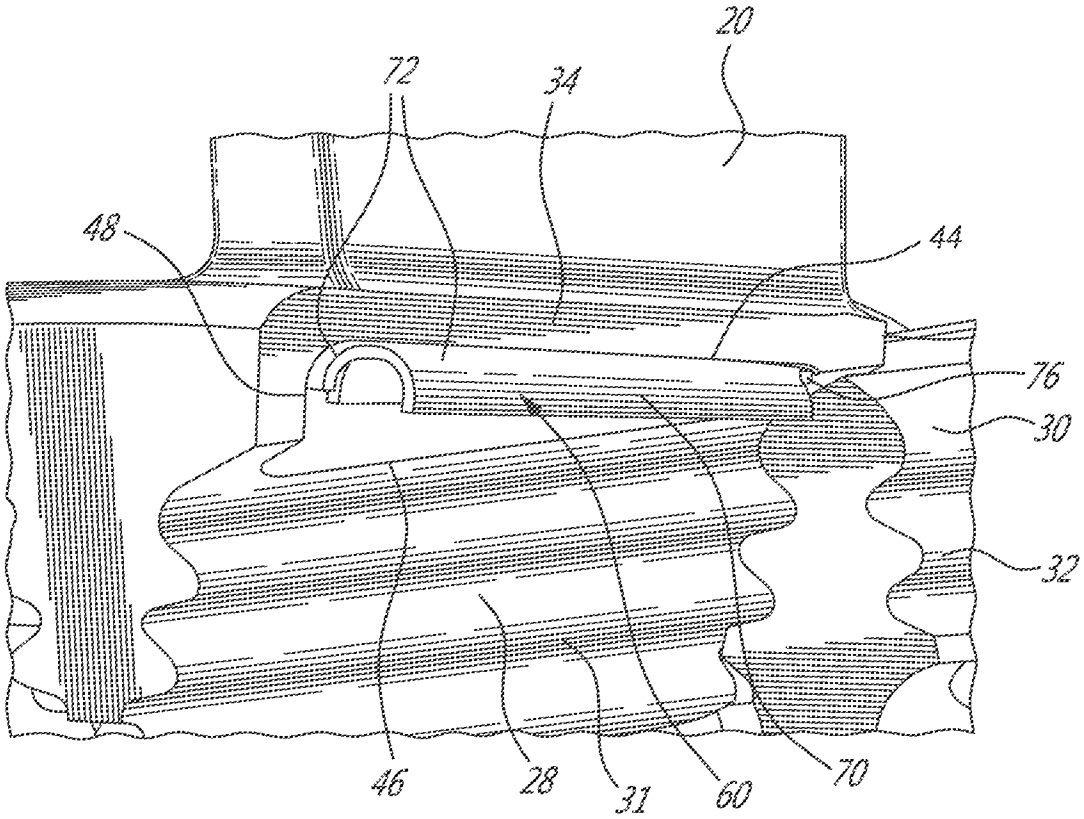
FIG. 6 is a schematic perspective exploded view of a portion of a rotating blade and the damper of FIG. 2A during a second step of installation of the damper and the blade in a hub of the gas turbine engine of FIG. 1.

Installation of the damper is illustrated in FIGS. 5 and 6. The root portions 28 of two adjacent blades 20 are first partially inserted in the fir-tree slots 29 (FIG. 5). The damper 60 is pivoted so as to have the lateral tabs 70 disposed in the radial direction R, and inserted between the root portions 28 of two adjacent blades 20 (FIG. 5). When reaching the recesses 36, 37, the damper 60 is pivoted 90 degrees so as to have the lateral tabs 70 disposed in the circumferential direction L with the top portion 64 facing the undersides 44 of the platforms 34 and the front tab 68 facing the leading edge walls 48. The damper 60 is then adjusted to contact the undersides 44 of the platforms 34 and the leading edge walls 48 (FIG. 6). Holding the damper 60 in this position, the adjacent blades 20 and the damper 60 are together slid axially completely into the fir-tree slots 29.

While the damper 60 is described herein for the compressor turbine 19, it is contemplated that the damper 60 could be adapted to rotor blades in portions of the gas turbine engine other than the compressor turbine 19. The gas turbine shown in FIG. 1 is only one example of a gas turbine engine which could receive the described damper 60.

The above description is meant to be exemplary only, and one skilled in the art will recognize that changes may be made to the embodiments described without departing from the scope of the invention disclosed. Other modifications which fall within the scope of the present invention will be apparent to those skilled in the art, in light of a review of this disclosure, and such modifications are intended to fall within the appended claims.

The invention claimed is:

1. A rotor blade vibration damper for a gas turbine engine, the vibration damper comprising:

an elongated damper body including a top portion extending longitudinally between a front end and a rear end, the top portion having a width defined between spaced apart lateral sides and being substantially flat between the front and rear ends and between the lateral sides such as to define a longitudinal plane within which the top portion lies, a front tab extending downwardly from the front end of the top portion relative to the longitudinal plane, the rear end of the top portion being flat and generally contained in the longitudinal plane, and a pair of lateral tabs extending downwardly from each of said lateral sides of the top portion relative to the longitudinal plane, the front tab and the lateral tabs all extending downwardly in a radially inward direction from the top portion and being substantially perpendicular to the longitudinal plane.

2. The damper of claim 1, wherein a bottom end of the lateral tabs is inclined relative to the longitudinal plane, such that each lateral tab is tapered toward the rear end.

3. The damper of claim 1, wherein the rear end includes a projecting tab, the projecting tab being generally contained in the longitudinal plane.

4. The damper of claim 3, wherein the projecting tab of the rear end is spaced from the lateral tabs.

5. The damper of claim 1, wherein a connection of the front tab to the top portion forms a curved edge.

6. The damper of claim 1, wherein connections of the lateral tabs to the top portion form curved edges.

7. The damper of claim 1, wherein the lateral tabs extend along about an entire length of the top portion.

8. The damper of claim 1, wherein a bottom end of the front tab is inclined relative to the top portion, such that the front tab is tapered circumferentially.

9. A gas turbine engine comprising:

a rotor including a hub defining a central axis of rotation and a plurality of blades radially extending from the hub, each of the blades having:

an airfoil portion; and a root portion, wherein each pair of adjacent blades have facing pressure side and suction side recesses in the root portion, the facing pressure side and suction side recesses forming a cavity; and a vibration damper disposed within each of the cavities, the vibration damper being displaceable radially within the cavity, the vibration damper including:

an elongated damper body having a length extending axially between upstream and downstream ends and a width extending circumferentially between spaced apart lateral sides, the damper body including a top portion conforming to a top wall of the cavity, the top portion defining a longitudinal plane, a front tab extending radially inwardly from the upstream end, a lateral tab extending radially inwardly from each of the lateral sides of the elongated portion, the downstream end being flat and aligned with the top portion, wherein the front tab and the lateral tabs that extend radially inwardly are substantially perpendicular to the longitudinal plane.

10. The gas turbine engine of claim 9, wherein the top portion is substantially flat between the upstream and downstream ends and between the lateral sides such as to define an axially extending plane within which the top portion lies.

11. The gas turbine engine of claim 9, wherein the top portion of the vibration damper body defines a sealing surface abutting the top wall of the recess in operation, and the vibration damper is a sole element received in the cavity.

12. The gas turbine engine of claim 9, wherein the rear end further comprises a flat rear tab aligned with the top portion.

13. The gas turbine engine of claim 9, wherein a bottom end of the lateral tabs is inclined relative to the top portion, such that each lateral tab is tapered toward the rear end.

14. The gas turbine engine of claim 9, wherein a connection of the front tab to the top portion and a connection of the lateral tabs to the top portion form curved edges.

15. The gas turbine engine of claim 9, wherein the lateral tabs extend along about an entire length of the top portion.

16. The gas turbine engine of claim 9, wherein a bottom end of the front tab is inclined relative to the top portion, such that the front tab is tapered circumferentially.

17. The gas turbine engine of claim 9, wherein the front tab is spaced from the lateral tabs.

18. The gas turbine engine of claim 9, wherein the adjacent facing pressure and suction side recesses forming the cavity are spaced by a circumferential gap, and the top portion of the vibration damper bridging the circumferential gap and, in use, abutting against the radial undersides of the platforms of the adjacent blades to seal the circumferential gap thereby limiting gas losses therethrough.

19. The gas turbine engine of claim 9, wherein an axial length of the damper is at least 50% of an axial length of the cavity.

20. The gas turbine engine of claim 9, wherein a radial height of the damper is at least 50% of a radial height of the cavity.

* * * * *